United States Patent [19]

Kosmatka et al.

[11] Patent Number: 4,464,600

[45] Date of Patent: Aug. 7, 1984

[54] LAMP UNIT HAVING ACCURATELY POSITIONED FILAMENT

[75] Inventors: Walter J. Kosmatka, South Euclid; Frank E. Zalar, Euclid, both of Ohio

[73] Assignee: General Electric Company, Schenectady, N.Y.

[21] Appl. No.: 380,483

[22] Filed: May 21, 1982

[51] Int. Cl.[3] ..... H01J 5/48; H01J 5/50

[52] U.S. Cl. ..... 313/318; 313/315; 339/145 R; 339/154 L

[58] Field of Search ..... 313/315, 318; 339/145 R, 154 L, 155 L, 206 L

[56] References Cited

U.S. PATENT DOCUMENTS

| | | | |
|---|---|---|---|
| 2,884,555 | 4/1959 | Peterson | 313/318 |
| 3,315,216 | 4/1967 | Krupp et al. | 313/318 X |
| 3,469,140 | 9/1969 | Bottone et al. | 313/318 |
| 3,885,149 | 5/1975 | Wolfe et al. | 313/318 |
| 4,012,658 | 3/1977 | Vause | 313/318 |
| 4,287,448 | 9/1981 | Bradley | 313/318 |
| 4,396,860 | 8/1983 | Hellwig et al. | 313/315 |

*Primary Examiner*—Saxfield Chatmon

*Attorney, Agent, or Firm*—John F. McDevitt; Philip L. Schlamp; Fred Jacob

[57] ABSTRACT

A light bulb is held by a base having an outer base member surrounding an inner member holding the bulb and which is secured to the outer base member after being adjusted longitudinally, laterally, and rotationally with respect thereto, as needed, to accurately position the bulb's filament with respect to the outer base member. No cement or adhesive is in contact with the light bulb.

7 Claims, 3 Drawing Figures

LAMP UNIT HAVING ACCURATELY POSITIONED FILAMENT

CROSS-REFERENCE TO RELATED APPLICATION

Ser. No. 380,482, filed concurrently herewith, Kosmatka and Zalar, "Lamp Unit Having Accurately Positioned Filament", assigned the same as this invention.

BACKGROUND OF THE INVENTION

The invention is in the field of based light bulbs having one or more filaments accurately positioned with respect to the base.

Light bulbs for certain uses require accurate positioning and alignment of their filament (or filaments) with respect to the base. For example, replaceable light bulbs for reflector lamps such as automobile headlamps are attached at their bases to the reflector, and the bulb's filament (or filaments) must be accurately positioned or centered at or with respect to the focal point of the reflector in order that the intended light beam pattern will be produced. Certain slide and movie projectors are further examples of optical equipment requiring accurate positioning of a lamp's filament with respect to its base.

Several ways have been devised for accurately positioning a light bulb's filament (or filaments) with respect to its base. For example, U.S. Pat. No. 3,885,149 to Wolfe discloses a prefocus lamp having a light bulb secured to a capping box which is held by a cup which is held by a cylindrical sleeve to which a focusing collar is attached in accurate alignment with the filament. U.S. Pat. No. 3,469,140 to Bottone discloses a light bulb cemented into a base and adjusted to align the filament with respect to the base while the cement is soft, and held in this position until the cement hardens. U.S. Pat. Nos. 3,904,909 and 3,960,278 to Vause disclose a lamp having metal brackets partially embedded in the bulb's pinch seal and in accurate alignment with the bulb's filament.

These prior base arrangements have various undesirable characteristics such as an expensive complexity of parts and/or requiring cement or metal parts adhered to the light bulb which, due to the high temperature when the lamp is operating (especially for halide lamps), can cause the bulb to crack. The range of choice for metals and cement adhesives in contact with the bulb is thus undesirably limited to those having thermal expansion coefficients similar to that of the bulb, and the adhesives are further limited to some generally expensive high-temperature types that usually require a relatively long time to harden, thus increasing the manufacturing cost.

SUMMARY OF THE INVENTION

Objects of the invention are to provide a simplified and inexpensive construction of a based prefocused light bulb and which does not require cement or any other material adhered to the bulb.

The invention comprises, briefly and in a preferred embodiment, a light bulb secured to a base, the base having an outer base member surrounding an inner member which supports the light bulb and which is secured to the outer base member, said inner member being adjustable longitudinally, laterally, and rotationally in said outer base member prior to said attachment thereto, whereby the filament of the lamp is accurately positioned with respect to the outer base member which functions as a means for attaching the lamp to a reflector or other device.

DESCRIPTION OF THE PREFERRED EMBODIMENTS

Figure 1:
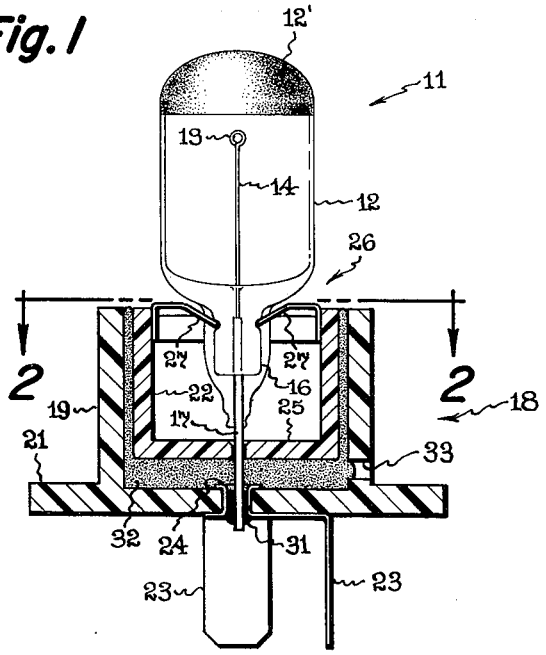
FIG. 1 is a side view of a preferred embodiment of the invention, the light bulb being shown in a side view and its base being shown in a cross-sectional view.
Figure 2:
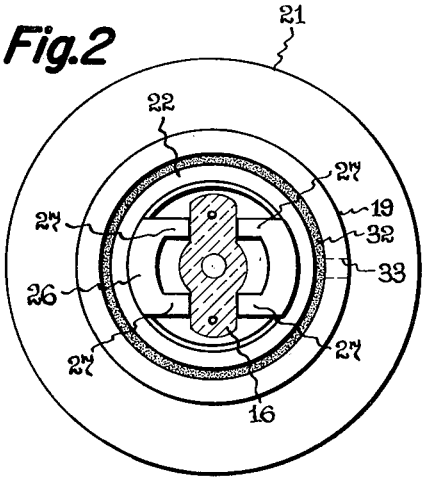
FIG. 2 is a view looking down on the line 2—2 of FIG. 1.
Figure 3:
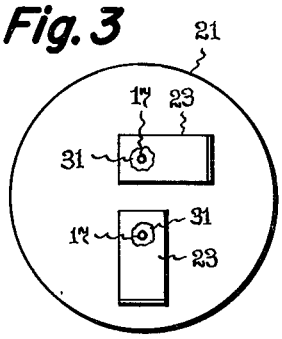
FIG. 3 is a bottom view of FIG. 1.

In FIG. 1, a light bulb 11, which may be an incandescent or arc type, and also may be a halogen gas type, has a bulb or envelope 12 which may be of suitable material such as glass or quartz. The bulb 12 contains a light source 13 shown as an incandescent-type filament (shown in end view) supported by a pair of inlead wires 14 held by a pinch seal region 16 of the bulb 12. Conventionally, molybdenum metal strips are hermetically sealed to the bulb material in the pinch seal 16, an end of each strip being respectively welded to the inlead wires 14, and the other end of each strip being respectively welded to a pair of lead-in wires 17 extending in a mutually parallel relationship exteriorly of the bulb 12. Two or more filaments 13 may be provided, such as hi-and-lo light beam filaments in an automobile headlight bulb, in which case there will be three or more inlead wires 14 and lead-in wires 17. Alternatively, the light source 13 may be an arc discharge. The end 12' of the bulb 12 may be blackened or coated to reduce glare.

The base 18 comprises an outer cup-shaped member 19, preferably cylindrical and of plastic material, and having a peripheral mounting flange 21. The base 18 further comprises an inner cup-shaped member 22, preferably of plastic, positioned within and spaced from the outer member 19. A plurality of terminals 23, which can be metal strips bent at right angles as shown, are attached to the outer member 19 such as by means of integral eyelets 24 extending through and peened over openings in the member 19 in alignment with the lead-in wires 17, which lead-in wires respectively pass through openings in the bottom 25 of member 22 and into or through the eyelets 24. A metal lamp-aligning and supporting washer or disc clip 26 fits within the inner member 22 and is provided with fingers 27 which resiliently engage against and frictionally hold the pinch seal 16. Thus the lamp bulb 11 and inner cup member 22 are frictionally supported in the inner member 22 without any adhesive or other material adhered to the bulb 12 or its pinch seal 16, and are adjustable in the outer cup member 19 with the lead-in wires 17 being slidable in or through the terminal eyelets 24, until the members are secured together as will be described. The mounting flange 21 may be configured to clip on or in or attach to a mounting such as an opening of a reflector, and may be a twist-in type as disclosed in U.S. Pat. No. 4,019,045 to Bassett.

The light bulb is quickly, easily, and economically secured to the base 18 so that the light source 13 is accurately aligned and positioned with respect to the unit's attachment member 21, as follows. Using visual or other suitable means, such as eyesight, measuring apparatus, an optical projection screen, or placing the lamp in a reflector and lighting the filament and observing or measuring the reflected projected light beam pattern, the bulb 11 and its attached inner cup member 22 are moved longitudinally and laterally within the outer cup member 19 to the desired correct positioning of the light source 13 with respect to the outer cup member 19 and its attachment member 21 (causing the lead-in wires 17 to tilt or bend slightly) and then the lead-in wires 17 are soldered 31 or otherwise attached to the eyelets 24 or the terminals 23, and the inner cup member 22 is attached and secured to the outer cup member 19 by cement or other adhesive 32 which is applied between these members around and/or under the inner cup member 22 prior to or after the aforesaid positioning of the members, whereupon after the aforesaid positioning of the members it hardens naturally or with the application of heat or a curing agent while the parts are maintained in correct position. The invention permits a further adjustment, if needed: the lamp 11 and inner cup member 22 can be rotated slightly within the outer cup member 19, prior to attachment thereto, to provide proper orientation of the filament 13 on a desired axis with respect to the outer cup member 22. This will slightly twist the lead-in wires 17 with respect to one another, which will not affect performance. The end result is a lamp unit with its light source 13 accurately positioned with respect to the mounting base part 21. Both the longitudinal and lateral positioning of the bulb 11 and inner cup member 22 in the outer cup member 19 generally are no greater than about 1/16 inch from the norm. The securing material 32 may be an inexpensive foaming polymetric compound, and a small lateral vent hole 33 may be provided in the outer cup member 19 to facilitate air escaping when the material 32 is applied.

The invention achieves accurate positioning of the bulb's light source (or sources) 13 with respect to the base's mounting and positioning member 21 without requiring any cement or other adhesive or any other material adhered or sealed to the lamp's bulb 12 or its press seal 16, thus obviating the prior art problems of attempting to match coefficients or expansion of the adjoining materials with the attendant problem of bulb cracking. Also, the adhesive 32 used to join the cup members 19 and 22 can include a wide variety of low-temperature and inexpensive types. In lieu of the metal terminals 23, the lead-in wires 17 can be adhesively adhered to the member 19 and protrude therefrom to provide the connection terminals. The lamp umit is impervious to dirt and moisture through the base, and the light bulb is vibration-resistant with respect to the base, even though no cement is in contact with the bulb.

While preferred embodiments and modifications of the invention have been shown and described, various other embodiments and modifications thereof will become apparent to persons skilled in the art and will fall within the scope of the invention and defined in the following claims. For example, the outer base member 19 can only partially surround the inner member 22, both as to height and circumference.

What we claim as new and desire to secure by Letters Patent of the United States is:

1. A lamp unit comprising a light bulb secured to a base, said light bulb containing a light source and having lead-in wires extending externally of the bulb, and said base comprising an inner member secured to said light bulb, lamp alignment and support means fitted within said inner base member to frictionally engage the light bulb in a fixed position aligned with respect to said inner base member, and an outer cup-shaped base member at least partly surrounding and spaced from said inner base member around the periphery and bottom thereof, the bottom of said cup-shaped outer base member being provided with openings into which said lead-in wires of the light bulb extend, and means securing said inner base member to said outer cup-shaped base member, whereby prior to said securing of the base members said light bulb and inner base members are longitudinally, laterally, and rotationally movable with respect to said outer base member thereby permitting accurate alignment of said light source with respect to said outer base member.

2. A lamp unit as claimed in claim 1, in which means securing said inner and outer base members together comprises an adhesive material therebetween.

3. A lamp unit as claimed in claim 2, in which said adhesive material comprises a foaming polymetric compound.

4. A lamp unit as claimed in claim 1, in which said light bulb comprises a pinch seal, and in which said inner base member is tubular and said lamp alignment and lamp support means is provided with fingers resiliently in engagement against said pinch seal.

5. A lamp unit as claimed in claim 1, in which said inner base member and said outer base member have circular cross-sections.

6. A lamp unit as claimed in claim 1, in which said outer base member is provided with terminals attached thereto by integral eyelets extending through said openings, said lead-in wires of the lamp extending into said eyelets.

7. A lamp unit as claimed in claim 5, in which said lead-in wires are soldered to said eyelets.

* * * * *